US007857115B2

(12) United States Patent
LeBrecque et al.

(10) Patent No.: US 7,857,115 B2
(45) Date of Patent: Dec. 28, 2010

(54) DEVICE FOR WORKING ON AN ESCALATOR

(75) Inventors: Douglas B. LeBrecque, West Springfield, MA (US); Craig A. Buckley, Glastonbury, CT (US); Troy R. Chicoine, Granby, CT (US); Thomas R. Charney, Bolton, CT (US); Richard S. Blakelock, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 12/439,260

(22) PCT Filed: Sep. 27, 2006

(86) PCT No.: PCT/US2006/037662

§ 371 (c)(1),
(2), (4) Date: Feb. 27, 2009

(87) PCT Pub. No.: WO2008/039191

PCT Pub. Date: Apr. 3, 2008

(65) Prior Publication Data

US 2009/0255777 A1 Oct. 15, 2009

(51) Int. Cl.
*B66B 21/02* (2006.01)

(52) U.S. Cl. ..... 198/326; 198/333

(58) Field of Classification Search ..... 198/321, 198/326, 333

See application file for complete search history.

(56) References Cited

U.S. PATENT DOCUMENTS 3,834,514 A * 9/1974 Wakamatsu ..... 198/325
4,244,457 A * 1/1981 Ernst ..... 198/321
4,265,353 A * 5/1981 Hill ..... 198/321

FOREIGN PATENT DOCUMENTS

JP 07215647 8/1995
JP 08059159 3/1996

OTHER PUBLICATIONS

Otis Technical Information Publication, TIP 30.3.1-6 Escalator Service Boards, Use and Upgrade Instructions, May 25, 2006.
International Search Report and Written Opinion of the International Searching Authority for International application No. PCT/US2006/037662 mailed Jun. 6, 2007.
International Preliminary Report on Patentability for International application No. PCT/US2006/037662 mailed Oct. 12, 2008.

* cited by examiner

*Primary Examiner*—James R Bidwell
(74) *Attorney, Agent, or Firm*—Carlson, Gaskey & Olds PC

(57) ABSTRACT

A device (42) useful for working on an escalator (20) provides a tread surface (50) that is obliquely oriented relative to an incline (I) of the escalator (20) during a maintenance or repair procedure. A disclosed example is useful for spanning at least a portion of an escalator (20) where the normal operating steps (22) have been removed for purposes of working on the escalator (20). A disclosed example includes a tread surface (50), a riser portion (52) that is at least partially generally perpendicular to the tread surface (50), a first axle hook (54) and a second axle hook (56). The axle hooks rest upon spaced axles (46) associated with the escalator for positioning a temporary step (44) as desired for facilitating working on the escalator.

21 Claims, 6 Drawing Sheets

DEVICE FOR WORKING ON AN ESCALATOR

FIELD OF THE INVENTION

This invention generally relates to passenger conveyors. More particularly, this invention relates to a device that is useful for working on a passenger conveyor such as an escalator.

DESCRIPTION OF THE RELATED ART

Passenger conveyors are used in a variety of settings. Escalators include a plurality of steps that move between landings at different levels to carry passengers between those levels. Occasionally there is a need for maintenance or repair of a passenger conveyor.

Some maintenance or repair procedures require removing some of the steps from the escalator machine to gain access to a space beneath the steps, for example. Under such circumstances, it is necessary to provide some way for a mechanic or technician to move along the portion of the escalator where the steps have been removed. This is particularly challenging especially when the steps have been removed along the incline portion of the escalator.

One approach has been to provide a so-called working board that establishes a planer surface upon which an individual can step or rest while performing work on the escalator. While such working boards have proven useful, they are not ideal. For example, the incline of the escalator and the corresponding incline of the working board can make it inconvenient or difficult for an individual to move into a desired position relative to the escalator while manipulating tools or pieces of the escalator itself such as the steps that are being removed or replaced.

It is desirable to provide a better arrangement for mechanics or technicians for working on escalators under circumstances where at least some of the normal operating steps have been removed. This invention addresses that need.

SUMMARY OF THE INVENTION

An exemplary device that is useful for working on escalators includes a tread surface. A first axle hook is near one end of the tread surface. A riser portion is at least partially generally perpendicular to the tread surface. A second axle hook is associated with the riser portion and spaced from the first axle hook. When the first and second axle hooks rest upon spaced axles on an escalator machine, the tread surface is at an oblique angle relative to an incline of the escalator machine.

The tread surface is generally horizontal and level when the axle hooks are in position on corresponding axles of the escalator machine. This allows for a horizontal stepping surface upon which an individual can walk or remain stationary while performing work on the escalator.

A disclosed example includes a handle associated with at least one of the tread surface or the riser portion that makes it easy to manually position or carry the device, for example.

In examples where a plurality of temporary steps are required, individual steps having a tread surface and riser portion are selectively placed on corresponding axles of the escalator. In one example, the first axle hook of one temporary step rests upon the same axle as the second axle hook of an adjacent temporary step.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Disclosed example embodiments of this invention are useful for facilitating a maintenance or repair procedure on a passenger conveyor such as an escalator. The disclosed examples provide an improved working surface that allows a mechanic or technician to more readily achieve a desired position relative to a selected portion of the escalator to carry out a maintenance or repair procedure. The disclosed examples provide a temporary step having a horizontal, level tread surface that makes it easier for an individual to carry out a maintenance or repair procedure compared to arrangements that have been used in the past.

Figure 1:
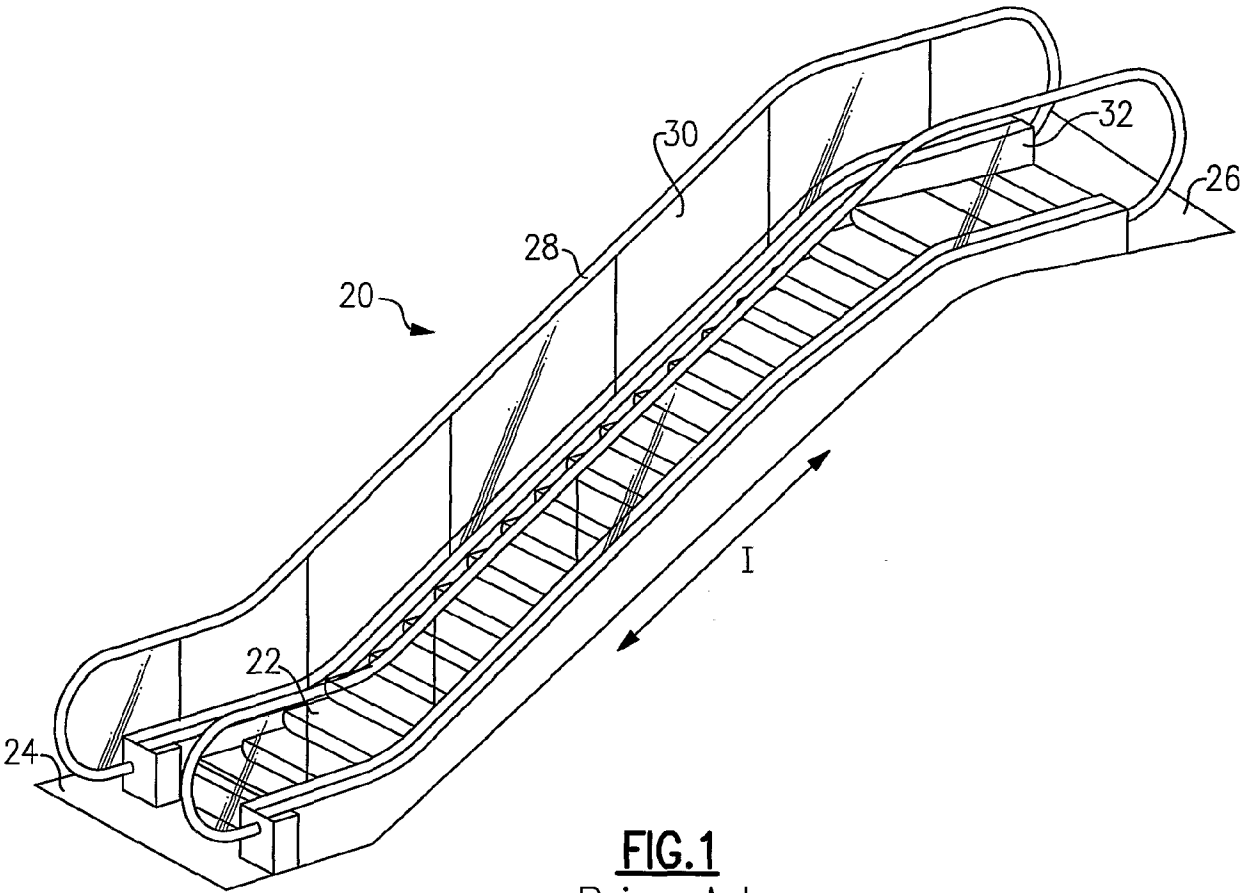
FIG.1 Prior Art
FIG. 1 diagramatically illustrates selected portions of an escalator having conventional components that operate in a known manner.

FIG. 1 illustrates selected portions of an escalator 20. A plurality of steps 22 are propelled by a drive machine in a known manner and move between landings 24 and 26 in a desired direction. As known, the steps 22 follow an incline I during at least a portion of their movement between the landings 24 and 26. The illustrated example escalator 20 includes a handrail 28, balustrade 30 and skirt panels 32. The steps 22, which are the normal, operating steps of the escalator 20 span essentially the entire distance between the skirt panels 32 on opposite sides of the escalator 20. A minimal clearance between the skirt panels 32 and the steps 22 provides known advantages.

Figure 2:
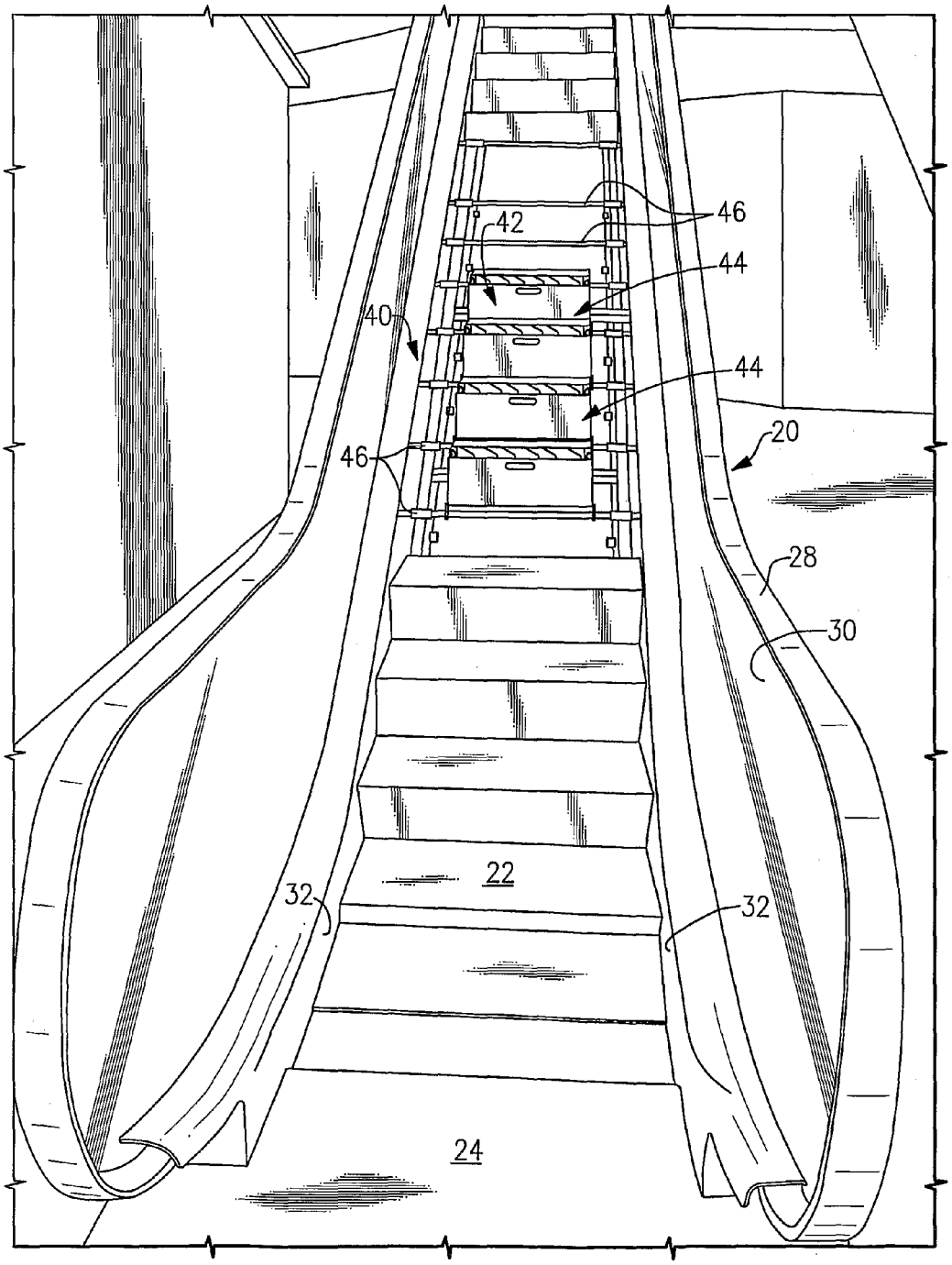
FIG. 2 diagramatically illustrates an example escalator during a portion of a maintenance or repair procedure where an example embodiment of this invention is employed.

FIG. 2 shows portions of an escalator 20 during a maintenance or repair procedure. In the example of FIG. 2, at least some of the steps 22 along the incline portion of the escalator have been removed. The illustrated example includes a section 40 of the escalator where the normal, operating steps 22 have been removed. An example device 42 facilitates a mechanic or technician moving along or remaining stationary in the portion 40 where the normal, operating steps 22 have been removed. In the illustrated example, the device 42 comprises a plurality of individual, temporary steps 44 that are supported on axles 46, which are a part of the escalator 20. In the illustrated example, the axles 46 extend across the entire distance between the skirt panels 32. The example axles 46 are otherwise each associated with one of the normal, operating steps 22. In other words, each normal, operating step 22 is associated with one of the axles 46 when the escalator 20 is arranged for normal operation to carry passengers, for example.

Figure 3:
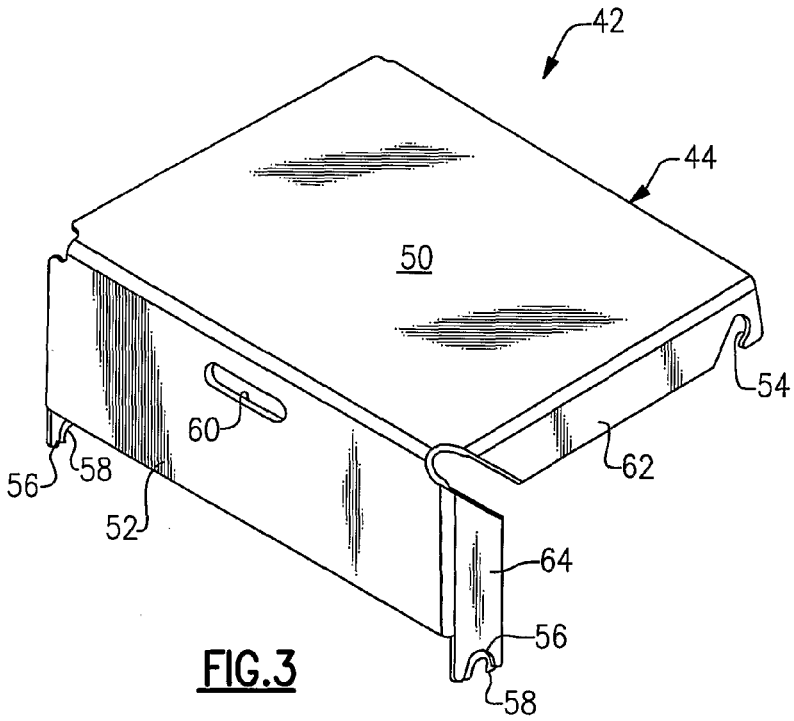
FIG. 3 is a perspective illustration of an example temporary step according to one example embodiment of this invention.

FIG. 3 shows one example configuration of a temporary step 44 that is a portion of the device 42 in the example of FIG. 2. In this example, the temporary step 44 includes a tread surface 50 upon which an individual can step while walking or standing while working on the escalator. A riser portion 52 is at least partially generally perpendicular to the tread surface 50.

A first axle hook 54 is associated with the tread surface 50 and, in this example, is near one end of the tread surface 50. The first axle hook 54 rests upon a selected one of the axles 46 when the temporary step 44 is in place on the escalator for use while working on the escalator. A second axle hook 56 is associated with the riser portion 52. The second axle hook in the illustrated example is near one end of the riser portion 52. The second axle hook 56 rests upon another one of the axles 46 when the temporary step 44 is in position on the escalator.

The first axle hook 54 has a surface that engages a selected amount of a corresponding axle 46. In the illustrated example, the first axle hook 54 at least partially wraps around at least a portion of a corresponding axle 46. In this example, one end of the first axle hook 54 includes a surface that engages a portion of the axle 46 facing in a direction opposite from the tread surface 50. In other words, when the temporary step 44 is in position, a portion of the first axle hook 54 is positioned to engage an underside of a corresponding axle 46. The illustrated example first axle hook 54 engages a corresponding axle 46 around at least 180° of a circumference of the axle 46. This example feature prevents the step 44 from tipping forward (e.g., pivoting about the lower axle 46 upon which the temporary step 44 is supported) if a force is applied to it that may tend to otherwise cause the step 44 to pivot about the axle upon which the second axle hook 56 is received. In some circumstances, the walking movement of an individual on the temporary steps 44 may produce such a force. The way that the example first axle hook 54, which is near the top of each temporary step 44 according to the illustration, engages an axle 46 prevents the temporary step from tipping in a way that the forward edge (e.g., the interface between the riser portion 52 and the tread surface 50) would move toward an adjacent step below it.

In the illustrated example, a bushing 58 is provided along the second axle hook 56 to provide a desired traction characteristic between the temporary step 44 and the corresponding axle 46. In one example, a polymer bushing material is used for the bushing 58 to reduce the amount of potential slipping between the second axle hook 56 and the corresponding axle 46. As known, the axles 46 typically have grease upon them and providing a bushing such as the bushing 58 facilitates a desired amount of stationary positioning of the temporary step 44 relative to the escalator.

The example of FIG. 3 includes a handle 60 for holding, positioning or carrying the temporary step 44. In this example, the handle 60 comprises a recess in the riser portion 52. The recess in this example comprises an opening through a surface of the riser portion 52.

In the illustrated example, the first axle hook 54 is formed in a flange 62 that extends from a lateral edge of the tread surface 50. Although only one is visible in the illustration of FIG. 3, a flange 62 is provided on each lateral edge of the example tread surface 50. In one example, the flanges 62 are oriented at approximately 80° relative to the tread surface 50 with the outermost edges of the flanges 62 being spaced apart farther than the widest lateral dimension of the tread surface 50.

In the example of FIG. 3, the second axle hook 56 at each end of the temporary step 44 is a part of a flange 64. The flanges 64 are oriented relative to the riser portion 52 in a similar manner as the flanges 62 described above. Having the flanges oriented in this manner allows for nestingly stacking a plurality of the temporary steps 44 for easy carrying and storage, for example.

Figure 4:
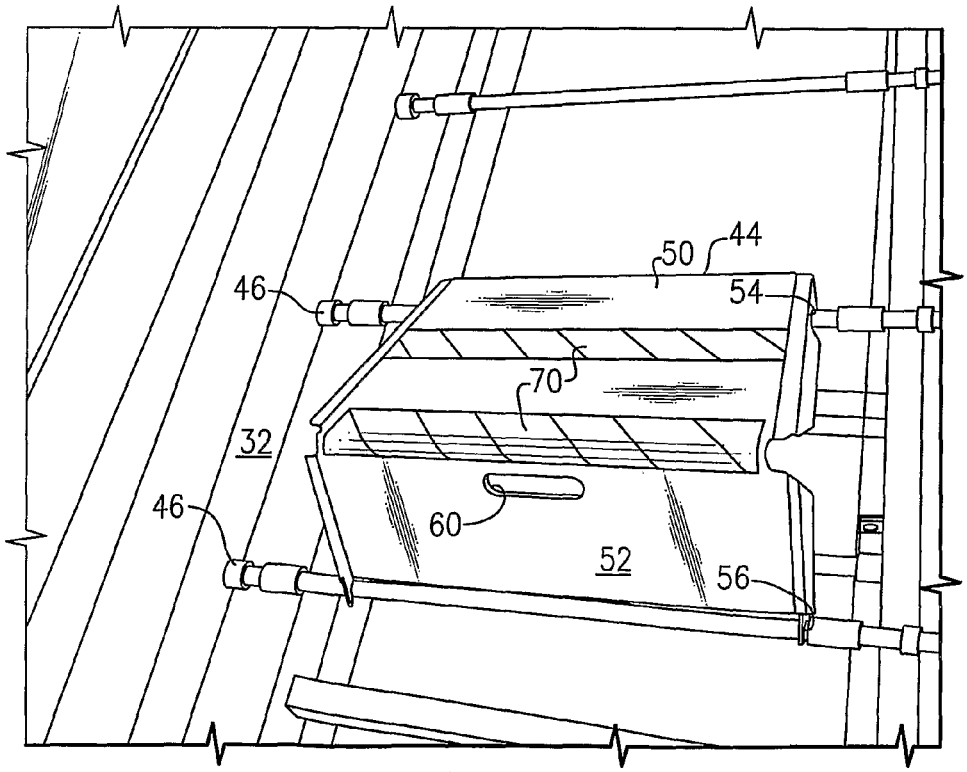
FIG. 4 illustrates the example of FIG. 3 in position on corresponding portions of an escalator.

FIG. 4 shows the example temporary step of FIG. 3 in position on selected axles 46 of an escalator. In this position, the tread surface 50 is at an oblique angle to the incline of the escalator. In most examples, the tread surface 50 will be horizontal and level in such a position.

The example of FIG. 4 includes an at least partially roughened surface 70 on at least some of the tread surface 50. In the illustrated example, the surface 70 comprises traction tape that is secured to selected portions of the tread surface 50. The roughened surface 70 provides for a desired amount of traction for an individual utilizing the device 42.

The example temporary step 44 differs from a normal, operating step 22 of an escalator in several respects. One difference is that the step 44 rests upon two of the axles 46. The normal, operating steps 22 are each associated with only one of the axles 46. Another difference is that the temporary step 44 in this example is intended only to be used when the escalator is stationary and the axles 46 are not moving relative to the skirt panels 32, for example.

Figure 5:
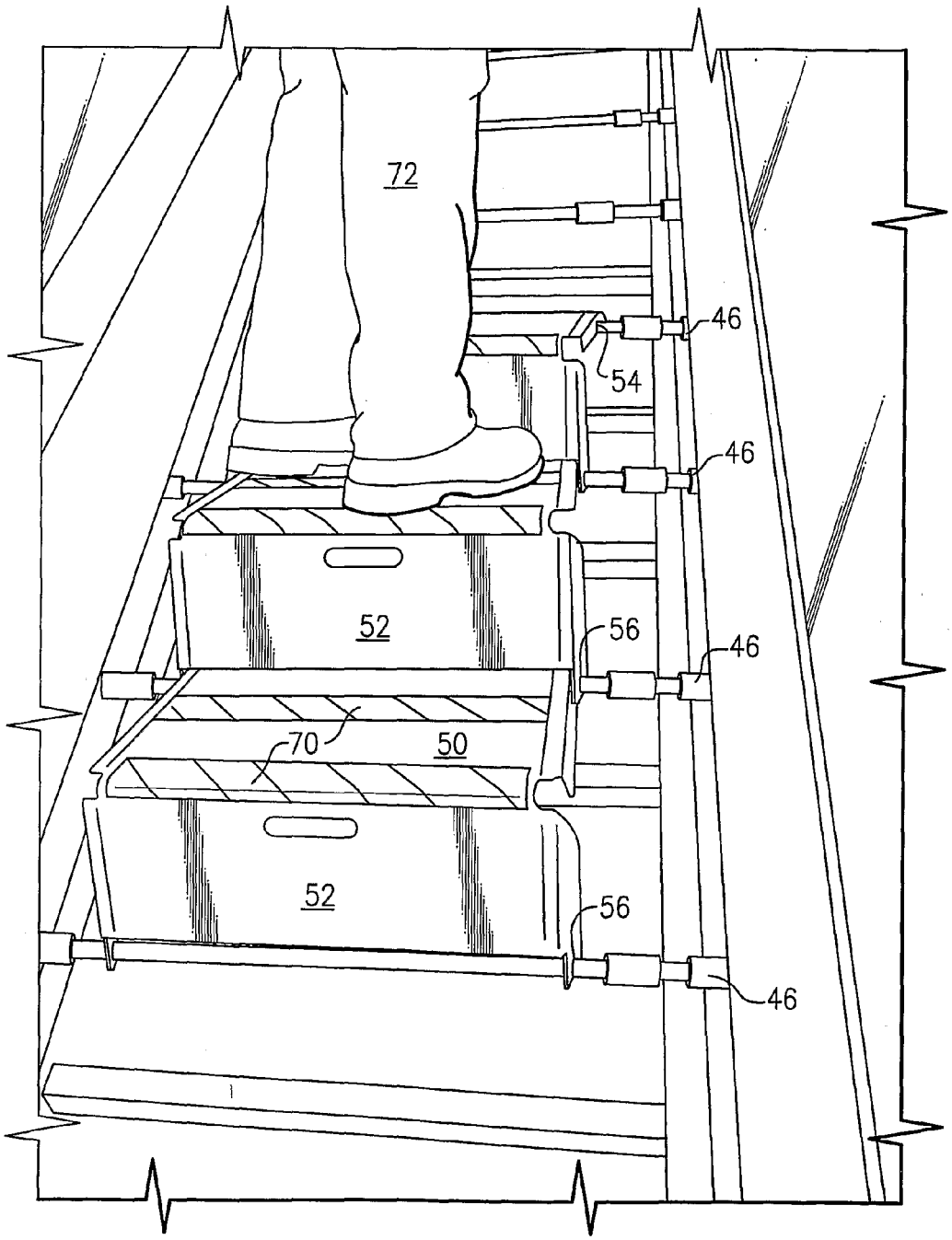
FIG. 5 illustrates a plurality of temporary steps corresponding to the example of FIG. 3 in a working position on an escalator.

Another difference is that a lateral dimension of the tread surface 50 along the direction of the axles 46 is significantly less than a distance between the skirt panels 32 such that there is an exposed area between at least one of the skirt panels 32 and the temporary step 44 as can be appreciated from the illustrations of FIGS. 2, 4 and 5, for example. In one example, the lateral width of the temporary step 44 is less than about 90% of a distance between the skirt panels 32. The smaller dimension of the temporary step 44 compared to a normal, operating step 22 facilitates working on portions of the escalator that are exposed where the normal operating steps 22 have been removed but still provides a stable, reliable surface upon which an individual can walk or position themself while working on the escalator.

FIG. 5 shows a plurality of the example temporary steps 44 arranged on the example escalator to provide a series of steps for a mechanic or technician 72. As can be appreciated from FIG. 5, the first axle hooks 54 associated with the tread surfaces 50 are received on the same axle 46 as the second axle hooks 56 of an adjacent one of the plurality of temporary steps 44. In this example, the second axle hooks 56 are positioned laterally outside of the first axle hooks 54 as can be appreciated from the illustration. A selected number of the temporary steps 44 can be used to span a selected distance along the escalator to facilitate working on the escalator.

Figure 6:
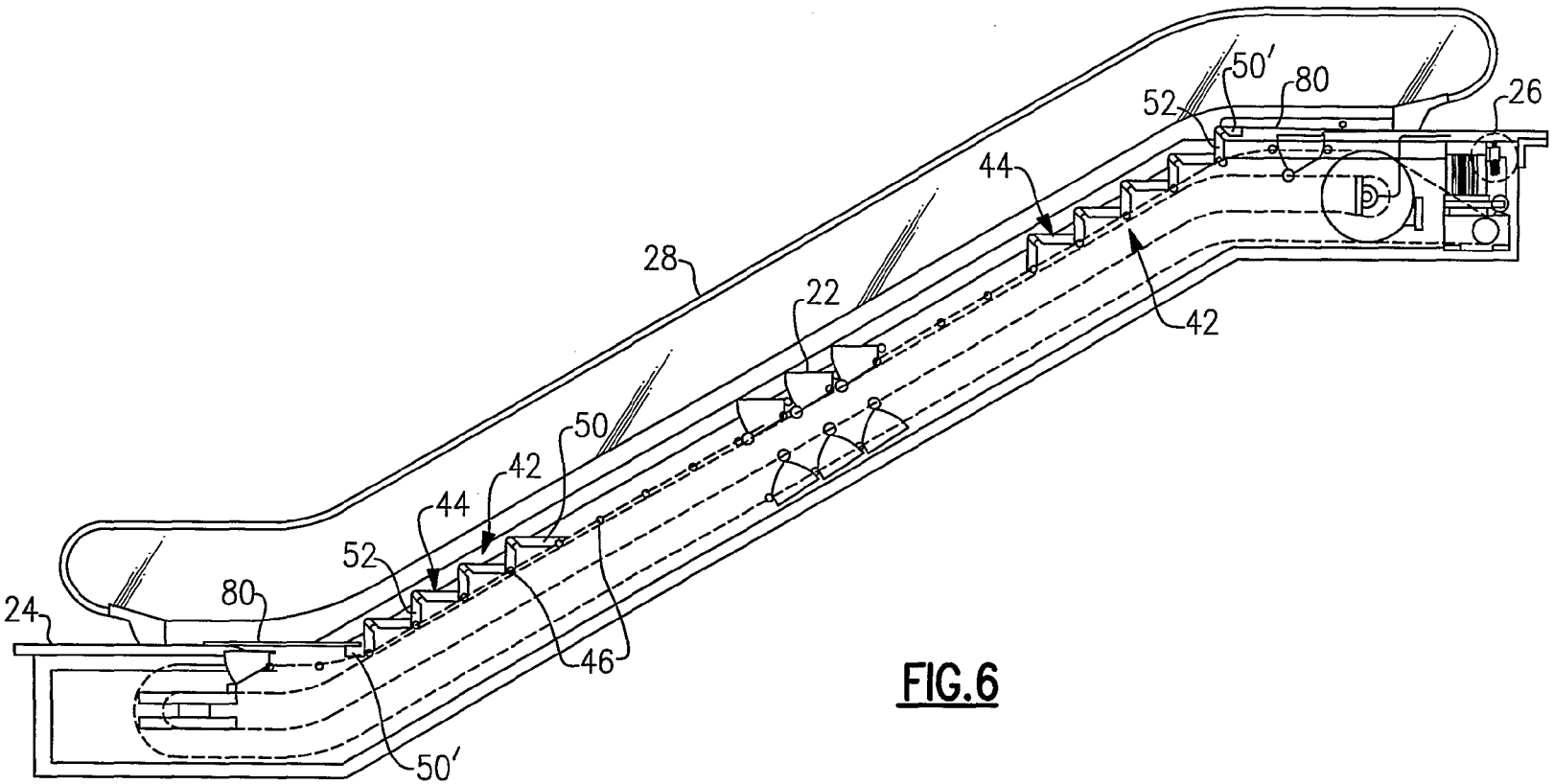
FIG. 6 schematically illustrates an example feature of one embodiment of this invention.

FIG. 6 schematically shows a feature of one example embodiment. In some situations, it is necessary to remove the normal operating steps 22 from the transition zones near the landings 24, 26 or both. The temporary steps 44 in this example are designed to rest upon the axles 46 along the incline of the escalator to provide a horizontal, generally level tread surface 50. In the transition zones, the relative positions of the axles 46 are different compared to the relative positions along the incline. Accordingly, one of the temporary steps 44 of the example of FIG. 3 would not provide a level tread surface 50 in the transition zone. The example of FIG. 6 includes modified temporary steps that are end work surfaces for providing a horizontal, level surface along the transition zones.

In this example, the end work surfaces have at least one of a tread surface 50' or a riser portion 52' with a corresponding axle hook. A planar support surface 80 spans a distance between one of the temporary steps 44 and the surface of the landing 24 or the landing 26. In the illustrated example, the end work surface 80 near the landing 24 has a first portion supported on a modified tread surface 50' that includes a first axle hook for resting on a selected axle 46 near the landing 24, which may be within or just outside of the transition zone. An opposite end of the planar surface 80 in this example rests upon a portion of the landing surface 24.

Near an opposite end of the example escalator of FIG. 6, an end work surface includes a generally planar surface 80 having a first portion that rests upon a portion of the landing surface 26. An opposite end of the surface 80 is supported on a modified tread surface 50', which is associated with a riser portion 52 having a second axle hook 56 that rests upon a selected one of the axles 46. The example arrangement of FIG. 6 allows for effectively spanning an entire length or any selected portion of the length of an escalator with a device 42 designed according to this invention to facilitate working on the escalator.

Figure 7:
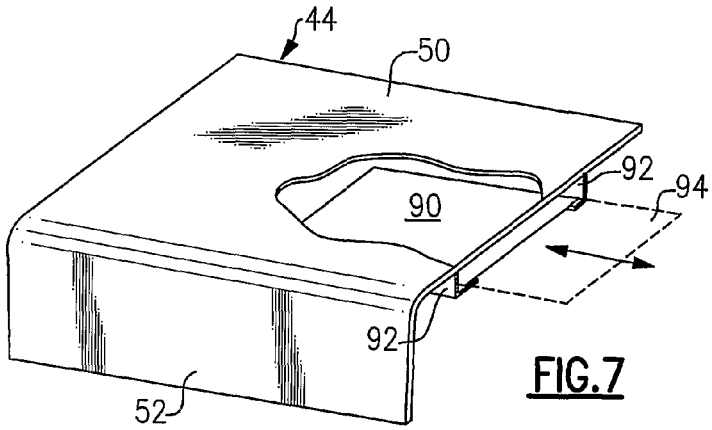
FIG. 7 schematically illustrates a feature of another example embodiment of this invention.

As mentioned above, the illustrated example temporary steps 44 leaving spacing between at least one side of the steps and a corresponding skirt panel 32. The example of FIG. 7 includes a feature for selectively providing a surface within at least a portion of that spacing as may be needed for a given situation. The example of FIG. 7 includes a moveable surface 90 that is supported by brackets 92. In this example, the brackets 92 are supported by a portion of the temporary step 44 corresponding to the tread surface 50. In this example, the moveable surface 90 is slideable along the brackets 92 between the position essentially beneath the tread surface 50 (according to the drawing) and another position shown in phantom at 94 where the surface 90 is exposed beyond the lateral edge of the tread surface 50. Having a moveable surface like the surface 90 allows for a mechanic or technician to have a surface for resting tools, escalator parts or service manual, for example. Although only one moveable surface 90 is shown in the example of FIG. 7, some example embodiments will have more than one moveable surface associated with at least one of the plurality of temporary steps 44. In one example, the moveable surface is supported for movement relative to the riser portion 52 while still providing a surface that is useful for at least partially spanning a spacing between a lateral edge of the temporary step 44 and a corresponding skirt panel 32.

Figure 8:
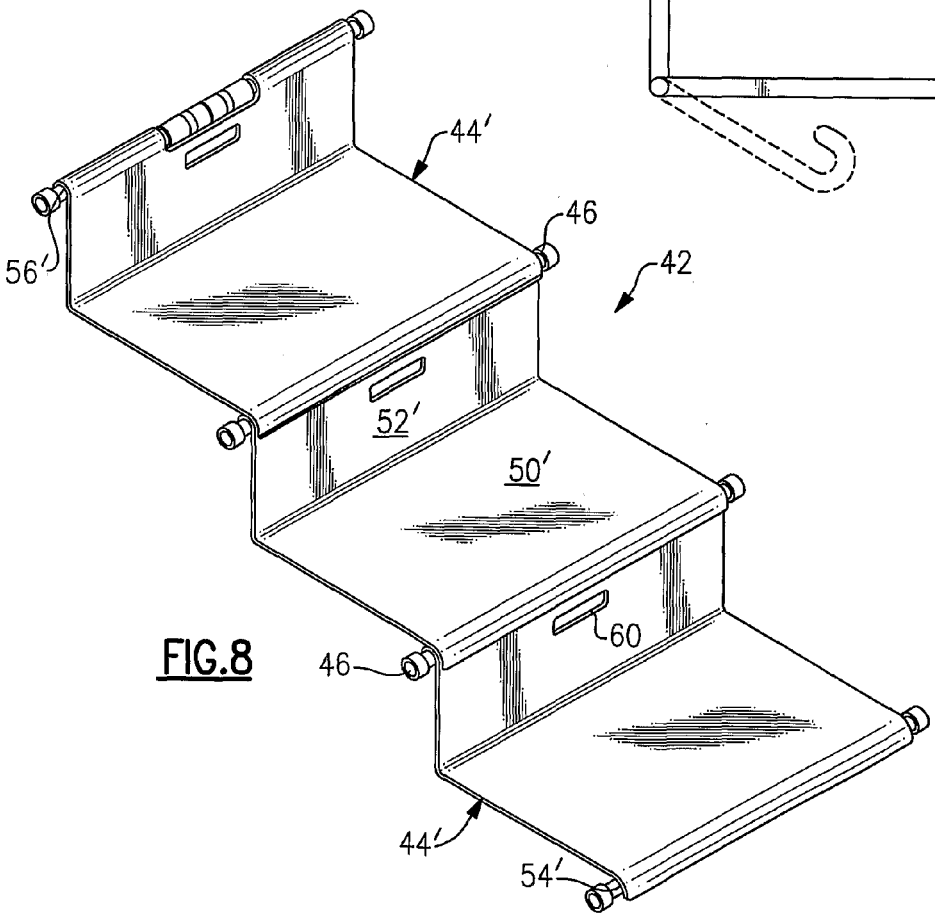
FIG. 8 is a perspective illustration of another example embodiment of this invention.

FIG. 8 shows another example embodiment where temporary steps 44' have an inverted configuration compared to the example of FIG. 3. The example of FIG. 8 is useful on some escalator arrangements but may not be useful on others that have cross members between the axles 46. One feature of this example is that the hook 54' extends across the entire length of the associated tread surface 50'. In this example, the hook 54' does not wrap partially around the corresponding axle like the hook 54 in the example of FIG. 3.

Figure 9:
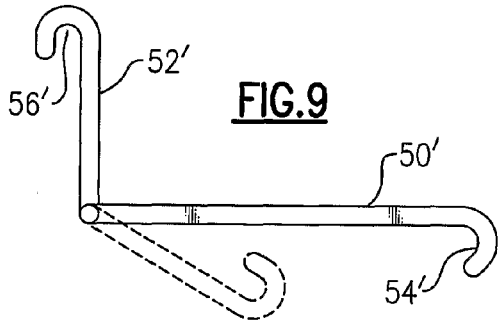
FIG. 9 schematically illustrates a feature of another example embodiment.

Another example embodiment is shown in FIG. 9. This example differs from the example of FIG. 8 in that the tread surface 50' and the riser portion 52' are hinged together so that the step is foldable as shown in phantom. In another example, the configuration shown in FIG. 3 is modified to include a hinged connection. A foldable step of this type preferably has a feature that secures the step in a working configuration to prevent folding while the step is in use. The foldability facilitates easier transportation and storage in some examples.

Given this description, those skilled in the art will realize what configuration of a device 42 designed according to an embodiment of this invention will best meet their particular needs based, at least in part, upon the configuration of the type of escalator with which the device 42 will be used.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for use when working on an escalator machine, comprising:

a tread surface;

a first axle hook near one end of the tread surface;

a riser portion at least partially generally perpendicular to the tread surface;

a second axle hook associated with the riser portion and spaced from the first axle hook such that when the first and second axle hooks rest upon spaced axles on an escalator machine, the tread surface is at an oblique angle relative to an incline of the escalator machine; and at least one moveable surface that is moveably supported by at least one of the tread surface or the riser portion such that the moveable surface is selectively moveable between a position beneath the tread surface to a position laterally outward of the tread surface.

2. The device of claim 1, wherein the oblique angle of the tread surface orients the tread surface approximately level in a horizontal direction if the device is supported in a desired position relative to an escalator machine.

3. The device of claim 1, wherein the first and second axle hooks rest upon the respective axles such that the tread surface and riser portion can be manually manipulated and lifted from the axles.

4. The device of claim 1, wherein the first axle hook is configured to engage an axle that is vertically higher than an axle that the second axle hook is configured to engage.

5. The device of claim 1, wherein the second axle hook engages an axle that is vertically higher than an axle that the first axle hook engages.

6. The device of claim 1, wherein the tread surface, the riser portion, the first axle hook and the second axle hook are all part of a single piece of material.

7. The device of claim 6 wherein the single piece of material comprises a metal sheet.

8. The device of claim 1, wherein the escalator machine has skirt panels near the ends of each axle, the skirt panels are spaced apart a first dimension and the tread surface has a second dimension configured to be oriented parallel to the axles that is less than about 90% of the first dimension if the device is supported in a desired position relative to an escalator machine.

9. The device of claim 1, wherein at least one of the axle hooks has a surface that engages a portion of the corresponding axle that faces in a direction opposite that the tread surface faces.

10. The device of claim 9, wherein the surface of the at least one of the axle hooks engages the corresponding axle around at least approximately 180°.

11. The device of claim 1, wherein the tread surface comprises an at least partially roughened surface.

12. The device of claim 11, wherein the at least partially roughened surface comprises traction tape secured to at least a portion of the tread surface.

13. The device of claim 1, comprising a handle associated with at least one of the tread surface or the riser portion for manually carrying the device.

14. The device of claim 13, wherein the handle comprises a recess in the at least one of the tread surface or the riser portion.

15. The device of claim 1, comprising a plurality of temporary steps each comprising the tread surface, riser portion, first axle hook and second axle hook, respectively, and wherein the first axle hook of one of the temporary steps and the second axle hook of an adjacent one of the temporary steps are each configured to rest on a common axle.

16. The device of claim 15, wherein the second axle hook of the adjacent one of the temporary steps comprises two spaced projections near an end of the riser portion of the adjacent one of the temporary steps and the first axle hook of the one of the temporary steps is configured to be received at least partially between the spaced projections if the corresponding first and second axle hooks are on the common axle.

17. The device of claim 15, wherein the plurality of temporary steps are stackable for at least one of storing or transporting the plurality of temporary steps, the plurality of tread surfaces are aligned with each other and the plurality of riser portions are aligned with each other and at least a portion of one of the temporary steps is nestingly received by an adjacent one of the temporary steps when the temporary steps are stacked.

18. The device of claim 15, comprising at least one end work surface having at least one of a tread surface or a riser portion with the corresponding axle hook and a planar support surface having a first portion supported by the at least one of the tread surface or riser portion and a second portion adapted to rest upon a landing near one end of the escalator machine.

19. The device of claim 1, wherein the tread surface and the riser portion are hinged together and selectively moveable relative to each other.

20. A device for use when working on an escalator machine, comprising:

a tread surface;

a first axle hook near one end of the tread surface;

a riser portion at least partially generally perpendicular to the tread surface;

a second axle hook associated with the riser portion and spaced from the first axle hook such that when the first and second axle hooks rest upon spaced axles on an escalator machine, the tread surface is at an oblique angle relative to an incline of the escalator machine; and wherein the tread surface and the riser portion are hinged together and selectively moveable relative to each other.

21. The device of claim 20, comprising at least one moveable surface that is moveably supported by at least one of the tread surface or the riser portion such that the moveable surface is selectively moveable between a position beneath the tread surface to a position laterally outward of the tread surface.

* * * * *